US010723966B2

(12) United States Patent
Navia Diez et al.

(10) Patent No.: US 10,723,966 B2
(45) Date of Patent: Jul. 28, 2020

(54) BIO-ADDITIVE FOR HEAVY OILS, WHICH COMPRISES RAPESEED OIL METHYL ESTERS, SURFACTANTS, DILUENTS AND METAL OXIDES, AND USE THEREOF FOR REDUCING POLLUTING EMISSIONS AND AS A COMBUSTION EFFICIENCY BIO-ENHANCER FOR HEAVY OILS

(71) Applicants: UNIVERSIDAD DE LA FRONTERA, Temuco (CL); MOLINERA GORBEA LIMITADA, Gorbea (CL)

(72) Inventors: Rodrigo Javier Navia Diez, Temuco (CL); Isaac Eliecer Reyes Caniupan, Temuco (CL); Tomas Guillermo Mora Chandia, Temuco (CL); Robinson Eugenio Betancourt Astete, Temuco (CL)

(73) Assignees: UNIVERSIDAD DE LA FRONTERA, Temuco (CL); MOLINERA GORBEA LIMITADA, Gorbea (CL)

( * ) Notice: Subject to any disclaimer, the term of this patent is extended or adjusted under 35 U.S.C. 154(b) by 0 days.

(21) Appl. No.: 15/740,262

(22) PCT Filed: Jun. 30, 2015

(86) PCT No.: PCT/IB2015/054930

§ 371 (c)(1),
(2) Date: Dec. 27, 2017

(87) PCT Pub. No.: WO2017/001896

PCT Pub. Date: Jan. 5, 2017

(65) Prior Publication Data

US 2018/0187114 A1 Jul. 5, 2018

(51) Int. Cl.

| | |
|---|---|
| ***C10L 10/02*** | (2006.01) |
| ***C10L 1/18*** | (2006.01) |
| ***C10L 1/12*** | (2006.01) |
| ***C10L 10/08*** | (2006.01) |
| ***C10L 10/12*** | (2006.01) |
| ***C10L 1/10*** | (2006.01) |
| *C10L 1/182* | (2006.01) |
| *C10L 1/185* | (2006.01) |
| *C10L 1/19* | (2006.01) |

(52) U.S. Cl.

CPC ..... *C10L 10/02* (2013.01); *C10L 1/10* (2013.01); *C10L 1/12* (2013.01); *C10L 1/18* (2013.01); *C10L 10/08* (2013.01); *C10L 10/12* (2013.01); *C10L 1/1233* (2013.01); *C10L 1/1824* (2013.01); *C10L 1/1857* (2013.01); *C10L 1/19* (2013.01); *C10L 2200/0209* (2013.01); *C10L 2200/0213* (2013.01); *C10L 2200/0236* (2013.01); *C10L 2200/0254* (2013.01); *C10L 2200/0438* (2013.01); *C10L 2200/0476* (2013.01)

(58) Field of Classification Search
CPC combination set(s) only.
See application file for complete search history.

(56) References Cited

U.S. PATENT DOCUMENTS

| | | | | |
|---|---|---|---|---|
| 2002/0050094 | A1* | 5/2002 | Taulbee | C10L 9/10 44/620 |
| 2004/0237385 | A1 | 12/2004 | Bongardt et al. | |
| 2008/0302001 | A1* | 12/2008 | Koivusalmi | C10G 45/62 44/308 |
| 2008/0312114 | A1 | 12/2008 | Ritter | |
| 2009/0288337 | A1* | 11/2009 | Picataggio | C10L 1/02 44/449 |
| 2011/0048354 | A1* | 3/2011 | Hollingshurst | B01F 17/0007 123/1 A |
| 2011/0258910 | A1* | 10/2011 | Siemssen | C10L 1/14 44/307 |
| 2013/0118058 | A1* | 5/2013 | Nguyen | C10L 1/1802 44/302 |

FOREIGN PATENT DOCUMENTS

| | | | |
|---|---|---|---|
| EP | 1990397 | A1 | 11/2008 |
| KR | 20040067031 | A | 7/2004 |

OTHER PUBLICATIONS

I. Celikten, et al; Improvement of performance and emission criterias of petrodiesel and rapeseed . . . ; Journal of the Faculty of Engineering and Architecture of Gazi University; vol. 26; No. 3; 2011; pp. 643-648.

S. Bhimani, et al; Emission characteristics of methanol-in-canola oil emulsions in a combustion chamber; Fuel; vol. 113; 2013; pp. 97-106.

S. Karthikeyan, et al; Diesel engine performance and emission analysis using canola oil methyl ester with the nano . . . ; Indian Journal of Engineering & Materials Sciences; vol. 21; 2014; pp. 83-87.

C. Sayin, et al; Effect of fuel injection pressure on the injection, combustion and performance characteristics of a DI diesel engine . . . ; Biomass and Bioenergy; vol. 46; 2012; pp. 435-446.

International Search Report dated Jan. 19, 2016 for PCT/IB2015/054930.

* cited by examiner

*Primary Examiner* — Ellen M McAvoy
*Assistant Examiner* — Chantel L Graham
(74) *Attorney, Agent, or Firm* — Lucas & Mercanti, LLP

(57) ABSTRACT

The present invention relates to a bioadditive for heavy oils that serves to reduce polluting emissions and bio-enhancer of the combustion performance for heavy oils, which comprises methyl esters of raps oil, also called raps biodiesel, in the range of up to 80% v/v, surfactants in the range of up to 80% v/v, diluents in the range of up to 20% v/v and metal oxides between 0.1-5 g/L.

6 Claims, 3 Drawing Sheets

*PM10 Concentration in normal conditions

*PM10 Concentration in normal conditions

BIO-ADDITIVE FOR HEAVY OILS, WHICH COMPRISES RAPESEED OIL METHYL ESTERS, SURFACTANTS, DILUENTS AND METAL OXIDES, AND USE THEREOF FOR REDUCING POLLUTING EMISSIONS AND AS A COMBUSTION EFFICIENCY BIO-ENHANCER FOR HEAVY OILS

CROSS REFERENCE TO RELATED APPLICATION

This Application is a 371 of PCT/IB2015/054930 filed on Jun. 30, 2015, which is incorporated herein by reference.

FIELD OF THE INVENTION

The present invention relates to the heavy fuels additives industry. In particular, the present invention relates to a formulation prepared mainly with methyl esters of rape oil (biodiesel from raps) and lower relative amounts of acetone, ethanol and copper and manganese oxides, and its use as a bioadditive for heavy fuels (Fuel No. 5 and 6), to be used in industrial burners such as boilers and furnaces, in order to reduce polluting emissions and bioenhancer of the combustion performance for heavy oils.

STATE OF ART

Currently, oil is one of the most used energy sources in the world. The quality of the oil is inversely related to its sulfur content (it is defined as "heavy" when it has around 2% sulfur content) and directly to its API gravity (or API degrees, from its acronym American Petroleum Institute), as illustrated in the following table:

| | Features | |
|---|---|---|
| Type of Oil | Density ($g/cm^3$) | Density ° API |
| Extra Heavy | >1.0 | 10.0 |
| Heavy | 1.0-0.92 | 10.1-22.3 |
| Medium | 0.92-0.87 | 22.3-31 1 |
| Light | 0.87-0.83 | 31.1-39.0 |

The world's oil supply has most of its reserves in the so-called heavy oils, which are more economical but are not widely used due to their greater contaminating characteristics, incurring in a higher cost, derived from the purification of these oils for their final use.

The high viscosity of heavy oils produces complexities to use them as a liquid fuel. Therefore it is preferred that these offer characteristics of: storage in liquid form; easy transfer between containers and towards the burner; rapid response of the power demand; and good atomization, to ensure an adequate mix with air for its combustion.

In order that these heavy fuels have these characteristics, it is necessary to constantly maintain them several tens of degrees above the ambient temperature, which requires an additional expense of fuel to provide the necessary energy.

On the other hand, the process of combustion in diffusive flame burners requires a good atomization, that is, the liquid fuel be separated into drops, as small as possible, to facilitate its mix with the oxygen of the air and generate the combustion reaction. The high viscosity of heavy fuels makes this process difficult. There are several ways to improve the atomization and one of them is to reduce the viscosity, decreasing the surface tension and improving the atomization.

A poor atomization also generates areas rich in fuel, or in other words, areas wherein there is little oxygen from the air, which causes an undesirable process in this application called pyrolysis, precursor of the particulate material. A good atomization and mixing reduces this problem. However, another way to reduce the pyrolysis is by supplying oxygen through other ways than ambient air, such as by means of an oxygenating agent.

It is for this reason that new technologies have been investigated in recent years that help to reduce the pollution caused by the extraction and purification and use of fuels (Hussein et al., 2006). One of the main developed technologies to help with the goal of reducing pollution are the additives.

A fuel additive is defined as a chemical substance that, added to another product generally in small quantities, gives it special properties or improves its natural properties. The additives are mainly used to improve the combustion of oils, reducing the emission of pollutants to the environment or improving engine power, among others. Currently, the trend in the research and production of fuel additives has focused mainly on the study of additives for lubricity, stability and increments of the number or cetane index (ie, the value that measures the capacity or ease of ignition).

In order to solve the above mentioned problems, there is a wide variety of fuel additives on the market, such as base-metallic additives, oxygenated additives, depressants and wax dispersers, ignition promoters and diesel blends with vegetable oil.

a. Base-Metallic Additives

The main effect of these additives is the catalysis of the hydrocarbons combustion. A large variety of metals have been studied as additives. Some examples of catalytic bases are: $Cs_2O$, $V_2O$ and $MoO_3$. And base compounds with: Mn, Mg, Ca, and Cu.

One of the most serious problems with respect to the emissions caused by diesel combustion is the presence of polycyclic aromatic hydrocarbons (PAHs) emissions, which have mutagenic and/or carcinogenic properties for humans, in addition to emissions, such as greenhouse gases and particulate material (PM, CO, HC and $NO_X$). Regarding this issue, studies confirm that the Base-Metallic additive that decreases these emissions in a greater proportion is the Base-Mn, being a great catalyst in diesel engines, improving the oxidation processes and considerably reducing the emissions of PAHs. It was demonstrated that when using diesel with the additive in Base-Mn, the cetane number and the net efficiency were increased, while the CO and $SO_2$ decreased. The reduction of $SO_2$ is explained due to the formation of $MnSO_4$ (Keskin, A. et al., 2007).

b. Oxygenated Additives

The idea of using oxygen to produce a cleaner burning, dates back more than half a century. Some of these compounds used are: ethanol, acetoacetic esters and dicarboxylic ester acid, among others.

These additives have been considered to reduce the ignition temperature of the particles. However, particulate emissions after the addition of oxygenated compounds depends on the molecular structure and oxygen content of the fuel.

The mixture of diesel with oxygenated additives affects properties, such as: density, viscosity, volatility, behavior at low temperatures and the cetane number. The presence of some oxygenated additives forms a lubricating film with anti-wear properties.

c. Depressants and Waxes Dispersers.

The petroleum distillate fuels contain various waxes, which are separated from the oil at low temperatures.

The waxes in general, crystallize like a net, with which the remaining fuel stagnates, causing problems of cold flow (flow in cold) as it is, the obstruction of fuel lines and filters in the systems of fuel engines. Various techniques have been studied to minimize the problems caused by the deposition of waxes in the engine systems, being the addition of polymeric inhibitors an important technological alternative.

This type of additives, wax dispersants, are of vital importance in countries with extensive winters. It has been shown that traditional dispersants (copolymers of olefins and vinyl acetate, among others) do not prevent the separation of fuel phases during the storage at low temperatures. As a result, the fuel is separated into two layers: a clear upper layer and a cloudy lower layer, which contains a large quantity of waxes. This effect consists in the formation of a large quantity of small wax crystals with great sedimentation stability.

The additives used for the prevention of the wax crystals sedimentation have an action mechanism that prevents the adsorption of these by the surfaces, and provides to the solution with a greater colloidal stability.

d. Ignition Promoters

For the internal combustion engines that operate with diesel as fuel, the cetane number of the fuel is one of the most important characteristics in the combustion process. Studies have shown that a decrease in ignition times, is directly related to an improvement in the speed of the cold start, a smoother operation of the engine and a decrease in $NO_X$ emissions.

Alkyl nitrates (amyl nitrite, hexyl nitrite and octyl nitrite) have been used as ignition promoters, some alkyl peroxides have also been proposed.

Commercially there are four major factors considered when choosing an ignition promoter, these are:

- The improvement of the fuel properties, to improve the ignition efficiency;
- The reduction of the risks associated with transport and storage;
- The existence of additional costs related to the cetane dilution and transport security; and
- The nitrogen content.

The alkyl nitrates, however, in addition to having a high efficiency also have serious inconveniences with respect to toxicity, corrosion and worsen the fuel color during the storage time. This is why currently new alternatives for ignition promoters are being investigated, being the organic peroxides one of the most attended.

e. Diesel Blends with Vegetable Oil

The Vegetable oils have a calorific value similar to that of diesel fuel, but their direct use has several negative consequences, such as: a decrease in atomization, an increase in carbon deposits in the injectors, accumulation of lubricating oils and fuel, increasing drastically the dirt of the engine, all this mainly due to the viscosity they possess. Treatments used to improve the viscosity of these oils can be: dilute them in an appropriate solvent, emulsify them, subject them to pyrolysis and subject them to the transesterification process to obtain biodiesel.

Many studies have investigated the possibility of using biomass or vegetable oils as a mixture with diesel fuel. These mixtures have shown a low emission of pollutants and an increase in the cetane number.

This biodiesel is defined as a liquid fuel composed of a mixture of alkyl esters obtained by the chemical reaction of transesterification or conversion of fatty acids to methyl esters of vegetable oils, animal fat or edible oil used. This organic fuel is non-flammable, non-toxic and biodegradable. In the transesterification of vegetable oils, a triglyceride (oil) reacts with an alcohol in the presence of a strong acid or base, producing a mixture of alkaline esters of fatty acids (biodiesel) and as a by-product glycerol or glycerin. This process allows reducing the viscosity of triglycerides, reinforcing the physical properties of these oils for the benefit of its known use as fuel in diesel engines.

The main characteristics of biodiesel are:

It keeps the engine injectors system free of deposits and dirt, therefore a better combustion is made and with it a decrease in the emissions of gases (CO and HC) and particulate material (greenhouse effect reduction, acid rain, respiratory diseases).

It protects the engine from the accelerated wear of the injection pump and the injectors, due to its great lubricating power.

It works on any conventional diesel engine, without any modification being necessary. It can be stored where the diesel oil is stored.

It can be used pure or mixed in any proportion with petroleum diesel fuel.

The biological cycle in the production and use of the Biodiesel reduces emissions of carbon dioxide by approximately 80%, and sulfur dioxide by almost 100%. The combustion of Biodiesel decreases by 90% the amount of total unburned hydrocarbons, and between 75-90% the aromatic hydrocarbons. It also provides significant reductions in the particulate material emission and carbon monoxide, which diesel oil also produces a slight increase or decrease in nitrogen oxides depending on the type of engine. Different studies have shown that biodiesel reduces the emanations of polycyclic aromatic hydrocarbons (PAHs), which have mutagenic and/or carcinogenic properties for humans.

Its use can extend the useful life of engines because it has better lubricating qualities than diesel fuel, while the consumption, ignition, performance, and torque of the engine remain practically at their normal values.

It is safe to handle and transport because it is biodegradable, and has a flash point of approximately 150° C. compared to petroleum diesel whose flash point is 50° C.

It has characteristics similar to diesel fuel, reason why it can be used directly or in mixtures with diesel in an internal combustion engine. The emissions caused by the use of biodiesel as a fuel have an almost total absence of sulfur oxides ($SO_X$), decreases the emissions of particulate material from soot, from polycyclic aromatic hydrocarbons and from carbon monoxide (CO), but there is an increase in the emissions of nitrogen oxides ($NO_X$); regarding to carbon dioxide ($CO_2$) emissions, it results null due to being organic compounds performing a natural cycle (carbon cycle), which, when adding the $CO_2$ absorption and emission, gives a result of zero. As has been described, the use of biodiesel represents great environmental and human health benefits, but regarding its use as a fuel it brings with it various technical problems to the engines in which they are used.

Some of the problems presented by the use of biodiesel as fuel, is its great oxidation capacity, which brings with it problems in the storage period, besides having problems in its use at low temperatures, due to its high viscosity, these are aspects not considered by automotive companies when manufacturing a car and could be avoided or diminished by the use of an appropriate additive.

As indicated above, due that heavy oil is cheaper but more polluting, the need arises to develop a bioadditive from raps biodiesel that allows the use of these oils in industry and transportation. It should be noted that the bioadditive of the present invention, is a new alternative for the use of biodiesel, which is used worldwide for the substitution of fuels and not as additives, for the reduction of the polluting characteristics of fossil fuels and to take advantage in other way from the qualities of this biofuel.

According to the application US20080312114, a bioadditive is described which includes poly-alpha-olefins, a source of calcium, and one or more oils or components derived from beans, seeds or roots, such as castor oil, jojoba oil, raps, seed oil, palm oil, sunflower oil, soybean oil, etc. However, the composition of said application is different from the composition of the bioadditive of the present invention as it does not comprise surfactants, diluents and metal oxides. In addition, the bioadditive of said application is directed to internal combustion engines, since it uses poly-alpha-olefins, which improve the lubrication of the engine cylinders. In contrast, the bioadditive of the present invention does not comprise poly-alpha-olefins and is oriented to industrial burners (which do not have cylinders to be lubricated) and to their use in heavy oils.

US20040237385: describes an additive based on the reaction generated by ethylene and fatty acids of raps. However, the components of this additive differ from the bioadditive components of the present invention because its focus is the lubrication and not the decrease in emissions. Furthermore, the composition of the application US20040237385 does not consider the use of metal oxides, such as, for example, manganese oxide, a component that is found in the present invention.

EP1990397 describes a fuel containing a mixture of liquid hydrocarbons (diesel, raps oil) and a universal additive dissolved in the hydrocarbon mixture. More specifically it comprises: Aliphatic C1-C4 monatomic saturated alcohol and water and/or saturated ammonium salt soluble in alcohol; C2-C5 monobasic carboxylic acid and/or carbonic acid; carbamide; and water. The present invention differs from this document because it adds oxygen to the mixture by biodiesel and not with carboxylic acid as is proposed in EP1990397. In addition, the biodiesel, despite being an additive, has a high calorific value well above the carboxylic acid.

Notwithstanding the above, the bioadditive of the present invention has a technical effect by reducing the viscosity of heavy fuels, and therefore, allowing a better transfer, atomization and oxygen supply, additionally to an additional channeling effect produced by the presence of metal oxides. In particular, the bioadditive of the present invention improves the results obtained by the commercial additive LUBRIZOL evaluated in the combustion of heavy fuels, reducing the emissions of particulate material emitted by around 5% with respect to the results achieved by the commercial additive. It is important to note that this 5% reduction is very significant considering that the bioadditive of the present invention is intended to be used in industrial burners and its use in heavy oils, so that the amount of particulate material emitted is much less than without the use thereof.

DESCRIPTION OF THE INVENTION

The present patent application discloses a bioadditive for heavy oils, for example Fuel Oil No. 5 and No. 6, which corresponds to a formulation comprising methyl esters of raps oil (raps biodiesel), surfactants, diluents and metal oxides, and the use of it in fuels to reduce polluting emissions and bio-enhancer of the combustion performance for heavy oils.

The bioadditive of the present invention is mainly made from *Brassica Napus* (also known as raps or canola) and is designed to be used in a mixture with petroleum, being an additive that provides several functionalities to the final product, such as the reduction of polluting gases up to 74% of carbon monoxide and 45% of PM10 compared to the emission of pure Fuel Oil No. 6. The bioadditive of the present invention comprises raps biodiesel in the range of up to 80% v/v (exemplified by 60%), a surfactant in the range of up to 80% v/v, containing up to 20% v/v of diluent and between 0.1-5 grams/liter of metal oxide. The total mixture of biodiesel and surfactant must add 80% between both components.

The surfactants and diluents that can be used for the formulation of the bioadditive are acetones or alcohols such as methanol, ethanol, propanol, butanol, ethyl alcohol, among others. The surfactant allows to obtain a very small fuel drop size and maintain the surface tension thereof, avoiding coalescence, thereby improving the combustion and reducing the emissions. The purpose of the diluent is to improve or optimize the mixture between the additive and the fuel, in order to have a homogeneous mixture.

Among the metal oxides that can be used are, for example, manganese oxide, magnesium oxide, calcium oxide, copper oxide and any other metal oxide. The function of this component is to act as a catalyst, improving the quality of the combustion, which minimizes the emissions in general, for example minimizing the particulate material emission. It also reduces unburned hydrocarbons, such as polycyclic aromatic hydrocarbons.

In addition, the bioadditive of the present invention is used to reduce polluting emissions and bio-enhancer of the combustion performance for heavy oils.

It is clearly observed that the additive of the invention allows reducing particulate matter (PM10) contaminating emissions from 134.2 mg/m$^3$ to 73.79 mg/m$^3$ (45% reduction) and that also using the bioadditive at 1% in the combustion of Fuel Oil No. 6, 179 Kg of $CO_2$ per ton of this combusted oil are not emitted.

Figure 2:
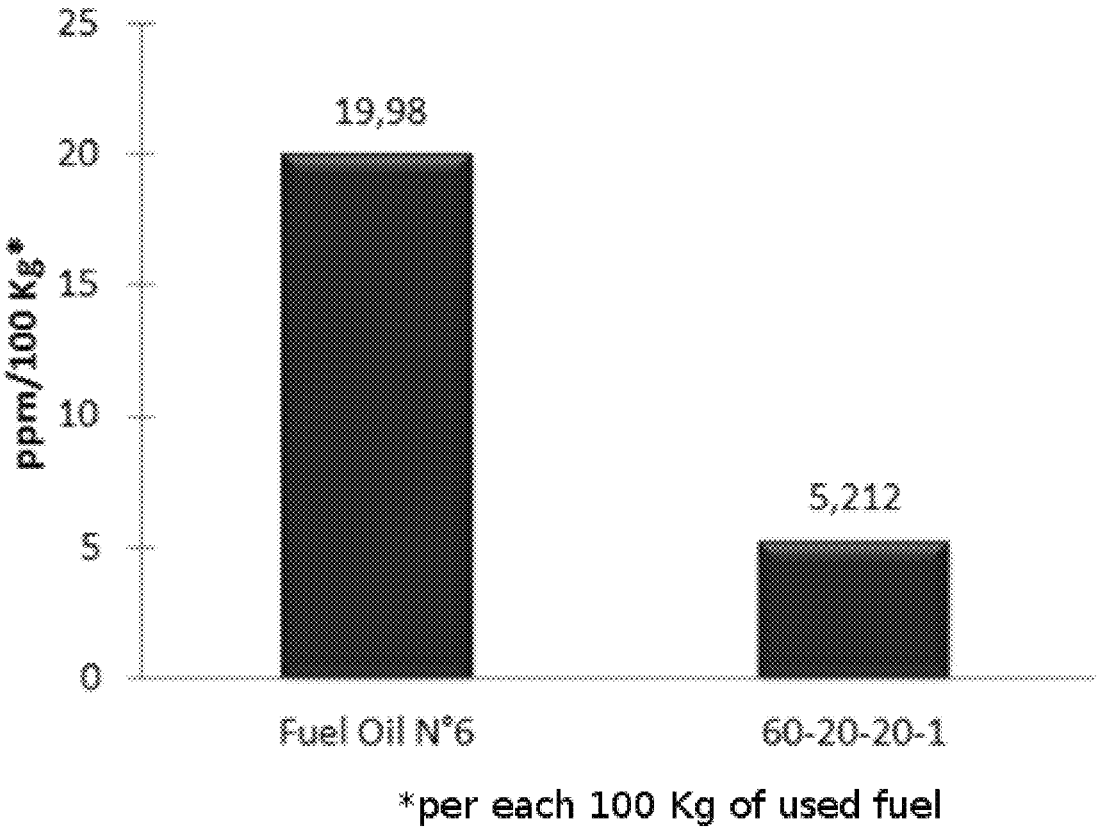

FIG. 2 shows the results of the emission of carbon monoxide (per 100 kg of fuel) from the operation of a saturated steam boiler burning at medium power with the application of the bioadditive of the present invention, with a fuel consumption of approximately 400 kg/h, an injection rate of approximately 4.4 L/h and a sampling time of 1.5 hours.

It is clearly observed that the additive of the invention allows reducing carbon monoxide contaminating emissions from 19.98 ppm/100 kg to 5.212 ppm/100 kg (74% reduction) and that also using the bioadditive at 1% in the combustion of Fuel Oil No. 6, 179 Kg of $CO_2$ per ton of this combusted oil are not emitted.

Figure 3:
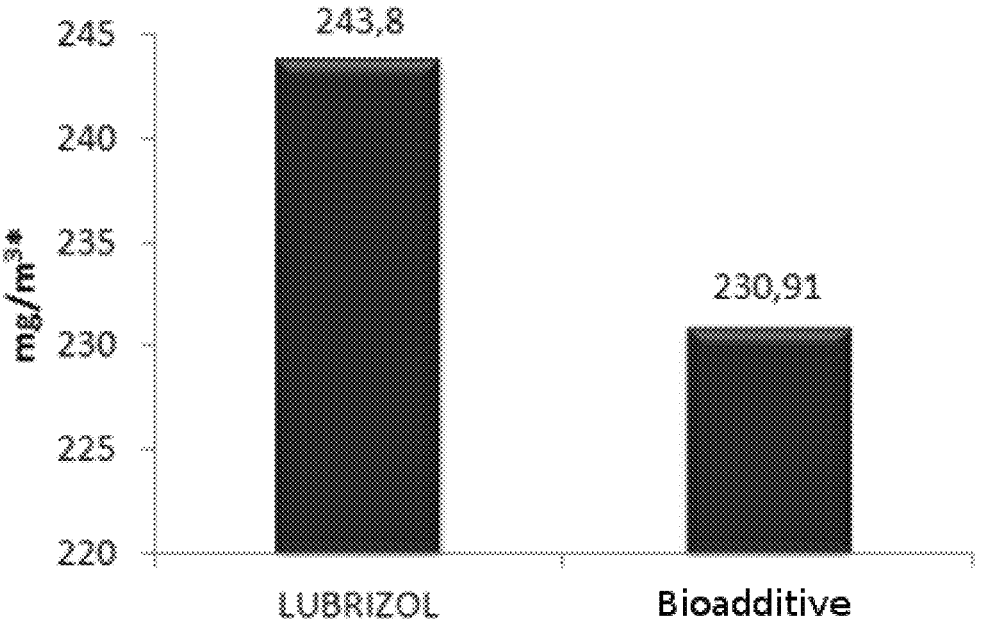

FIG. 3 shows the results of the particulate material emission (PM10) from the operation of a saturated steam boiler burning at medium power with the application of the bioadditive of the present invention compared to the application of a commercial additive (LUBRIZOL), with a fuel consumption of approximately 400 kg/h, an injection rate of approximately 4.4 L/h and a sampling time of 1.5 hours for both cases.

It is clearly observed that the additive of the invention has an improved result in the reduction of particulate matter (PM10) contaminating emissions with respect to the use of a commercial additive such as LUBRIZOL. The particulate material emission in the combustion of Fuel Oil No. 6 using LUBRIZOL was 243.8 mg/m$^3$ while the particulate material emission in the same combustion of Fuel Oil No. 6 using the bioadditive of the present invention was 230.91 mg/m$^3$, it is important to note that in addition to using the bioadditive at 1% in the combustion of Fuel Oil No. 6, 11 kg of $CO_2$ per ton of this combusted oil are not emitted due to its renewable character.

EXAMPLES OF APPLICATION

Example 1

It was studied the particulate material emission (PM10) from the operation of a saturated steam boiler burning at medium power with the application of the bioadditive of the present invention, with a fuel consumption of approximately 400 kg/h, an injection rate of approximately 4.4 L/h and a sampling time of 1.5 hours.

The composition used for this test was 60% of raps Biodiesel, 20% of surfactant ethanol, 20% of acetone diluent and 1 g/L of manganese oxide. (A-60-20-20-1). About 1% of "A-60-20-20-1" was added to Fuel Oil No. 6 to perform the comparative tests.

Figure 1:
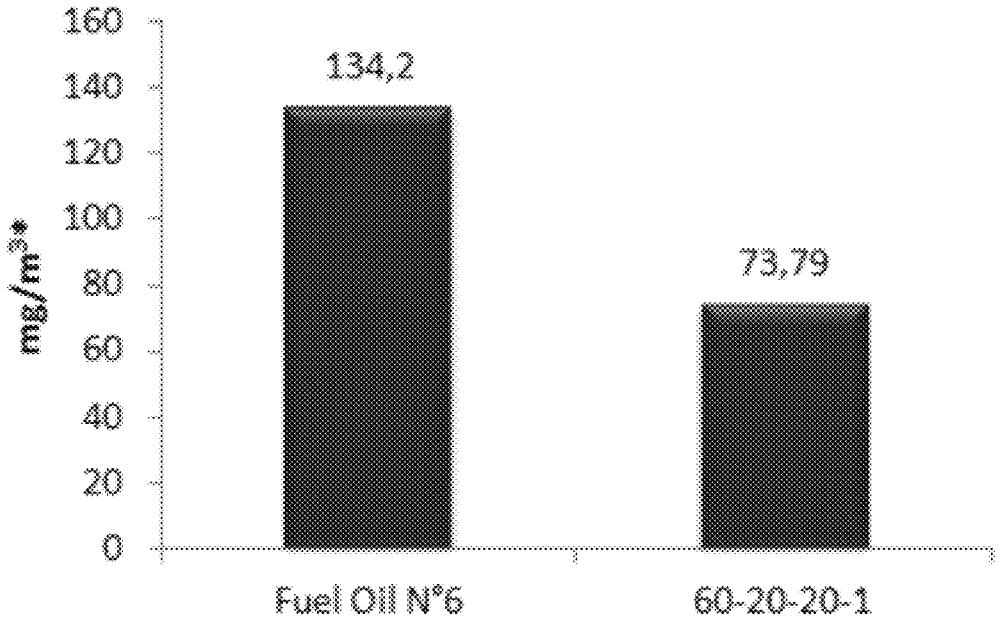
FIG. 1 shows the results of the particulate material emission (PM10) from the operation of a saturated steam boiler burning at medium power with the application of the bioadditive of the present invention, with a fuel consumption of approximately 400 kg/h, an injection rate of approximately 4.4 L/h and a sampling time of 1.5 hours.

FIG. 1 shows the difference between the emission of PM10 from the Fuel Oil No. 6 containing the bioadditive of the present invention versus the pure Fuel Oil No. 6. It is clearly observed a 45% decrease in PM10 emissions compared to pure fuel.

Example 2

It was studied the emission of carbon monoxide from the operation of a saturated steam boiler burning at medium power with the application of the bioadditive of the present invention, with a fuel consumption of approximately 400 kg/h, an injection rate of approximately 4.4 L/h and a sampling time of 1.5 hours.

The composition used for this test was 60% of raps Biodiesel, 20% of surfactant ethanol, 20% of acetone diluent and 1 g/L of manganese oxide. (A-60-20-20-1). It was added about 1% of "A-60-20-20-1" to Fuel Oil No. 6 to perform the comparative tests.

FIG. 2 shows the difference between the emission of carbon monoxide from Fuel Oil No. 6 containing the bioadditive of the present invention versus the pure Fuel Oil No. 6. A great performance has been demonstrated, reducing the carbon monoxide emissions by 74% compared to pure fuel.

Example 3

It was studied the emission of particulate material from the operation of a saturated steam boiler burning at medium power with the application of the commercial additive LUBRIZOL versus the application of the bioadditive of the present invention, in a saturated steam boiler used at 4762 kW of power that operates with Fuel Oil No. 6.

The composition used for this comparative test was 61.9% of raps Biodiesel, 23.81% of surfactant ethanol, 14.29% of acetone diluent and 0.5 g/L of manganese oxide. (A-60-20-20-1). It was added about 1% of "A-60-20-20-1" and also 1% of commercial additive LUBRIZOL to Fuel Oil No. 6, to perform the comparative tests.

FIG. 3 shows the difference between the emission of particulate material of Fuel Oil No. 6 containing the bioadditive of the present invention versus the Fuel Oil No. 6 containing the commercial additive LUBRIZOL. It has been demonstrated a better performance of the bioadditive, reducing carbon monoxide emissions by 5% compared to the results achieved by the commercial additive.

The invention claimed is:

1. A bioadditive for heavy oils that reduces polluting emissions and bio-enhancer of the combustion performance for heavy oils, comprising methyl esters of raps oil (raps biodiesel), in the range of 60% to 80% v/v, surfactant in the range of up to 20% v/v, acetone in the range of up to 20% v/v, and metal oxide between 0.1-5 g/L.

2. The bioadditive of claim 1, wherein the surfactant used is acetone or an alcohol.

3. The bioadditive of claim 2, wherein the alcohol is selected from the group consisting of methanol, ethanol, propanol, butanol, and ethyl alcohol.

4. The bioadditive according to claim 1, wherein the metal oxide is selected from the group consisting of manganese oxide, magnesium oxide, calcium oxide, and copper oxide.

5. The bioadditive of claim 1, wherein the raps biodiesel is 60% v/v, the surfactant is 20% v/v, and the metal oxide manganese oxide is 1 g/L.

6. The bioadditive of claim 1, wherein the raps biodiesel is 60% v/v, the surfactant is 20% v/v, acetone is 20% v/v and the metal oxide manganese oxide is 1 g/L.

* * * * *